United States Patent [19]

Kondo et al.

[11] Patent Number: 5,039,338

[45] Date of Patent: Aug. 13, 1991

[54] ELECTROLESS COPPER PLATING SOLUTION AND PROCESS FOR FORMATION OF COPPER FILM

[75] Inventors: Koji Kondo, Chiryu; Seiji Amakusa, Kariya; Katuhiko Murakawa, Toyota; Katsuaki Kojima, Nagoya; Nobumasa Ishida, Chiryu; Junji Ishikawa; Futoshi Ishikawa, both of Nagoya, all of Japan

[73] Assignee: Nippondenso Co. Ltd., Kariya, Japan

[21] Appl. No.: 456,659

[22] Filed: Dec. 29, 1989

[51] Int. Cl.[5] ..... C23C 18/40; C23C 18/38; C23C 18/31; C23C 18/54

[52] U.S. Cl. ..... 106/1.18; 106/1.22; 106/1.23; 106/1.26; 427/304; 427/305; 427/306; 427/437; 427/443.1

[58] Field of Search ..... 106/1.23, 1.22, 1.26, 106/1.18; 427/305, 437, 304, 306, 443.1

[56] References Cited

U.S. PATENT DOCUMENTS

| | | | |
|---|---|---|---|
| 4,265,943 | 5/1981 | Goldstein et al. | 427/305 |
| 4,301,196 | 11/1981 | McCormack et al. | 427/305 |
| 4,448,804 | 5/1984 | Amelio et al. | 427/98 |
| 4,617,205 | 10/1986 | Darken | 106/1.23 |
| 4,650,691 | 5/1987 | Kinoshita et al. | 427/8 |
| 4,684,545 | 8/1987 | Fey et al. | 427/98 |
| 4,834,796 | 5/1989 | Kondo et al. | 106/1.23 |

FOREIGN PATENT DOCUMENTS

| | | |
|---|---|---|
| 164580 | 12/1985 | European Pat. Off. . |
| 55-76054 | 6/1980 | Japan . |
| 59-25965 | 2/1984 | Japan . |
| 59-143058 | 8/1984 | Japan . |
| 60-15917 | 1/1985 | Japan . |
| 60-159173 | 8/1985 | Japan . |
| 60-218479 | 11/1985 | Japan . |
| 60-218480 | 11/1985 | Japan . |
| 62-168871 | 4/1989 | Japan . |

OTHER PUBLICATIONS

"Effects of Ligant to Rate of Electroless Copper Plating", translation of Tom 7, No. 5, 1971), NO English translation.

Francis J. Nuzzi, "Accelerating the Rate of Electroless Copper Plating" (Plating and Surface Finishing, Jan. 1983, pp. 51–53).

Derwent Abstract 86-295305/45 of JP 61-217581; Sep. 86, to Sumitomo Metal.

Derwent Abstract 88-074513/11 of JP 63-28877; Feb. 88, to Matsushita Electric.

*Primary Examiner*—William R. Dixon, Jr.
*Assistant Examiner*—Scott L. Hertzog
*Attorney, Agent, or Firm*—Cushman, Darby & Cushman

[57] ABSTRACT

Disclosed are an electroless copper plating solution comprising a copper ion, a copper ion-complexing agent, a reducing agent and a pH-adjusting agent, the plating solution comprising a trialkanolmonoamine or a salt thereof as a complexing agent and accelerator in an amount giving a higher copper deposition speed than the copper deposition speed obtained when the trialkanolmonoamine or salt thereof is present in an amount sufficient to complex the copper ion but not enough to function as the accelerator, and $1.2\times10^{-4}$ to $1.2\times10^{-3}$ mole/l of an iron ion compound as a reaction initiator and/or $1.92\times10^{-4}$ to $1.92\times10^{-3}$ mole/l of at least one compound selected from the group consisting of pyridazine, methylpiperidine, 1,2-di-(2-pyridyl)ethylene, 1,2-di-(pyridyl)ethylene, 2,2'-dipyridylamine, 2,2'-bipyridyl, 2,2'-bipyrimidine, 6,6'-dimethyl-2,2'-dipyridyl, di-2-pyridylketone, N,N,N',N'-tetraethylethylenediamine, naphthalene, 1,8-naphthyidine, 1,6-naphthyridine, tetrathiafurvalene, α,α,α-terpyridine, phthalic acid, isophthalic acid and 2,2'-dibenzoic acid as an agent for improving the physical properties of a plating film, and a process for forming an electroless copper deposition film by using this electroless copper plating solution.

13 Claims, 6 Drawing Sheets

RELATIONSHIP BETWEEN AMOUNT OF TRIETHANOLAMINE ADDED AND DEPOSITION SPEED

TENSILE TEST PIECE

TIME STRAIN CURVE AT TENSILE TEST $CuCl_2$=0.04M
TEA= 0.12M
POTASSIUM FERROCYANIDE=300mg/ℓ
EDTA 0.01M
BATH TEMPERATURE 60°C

AMOUNT OF 2,2'-BIPYRIDYL WAS CHANGED UNDER THESE CONDITIONS (OTHER CONDITIONS REMAINED CONSTANT)

ELECTROLESS COPPER PLATING SOLUTION AND PROCESS FOR FORMATION OF COPPER FILM

BACKGROUND OF THE INVENTION

1. Field of the Invention

The present invention relates to an electroless copper plating solution and a process for the formation of a copper film with this plating solution. More particularly, the present invention relates to an electroless copper plating solution for forming all copper films, such as copper films used for conductor circuits of printed circuit boards, copper films for conductor circuits on ceramic substrates, and copper films to be used for electromagnetic wave shielding materials, and a process for forming copper films by using this plating solution.

2. Description of the Related Art

As the electroless copper plating solution for electrolessly depositing metallic copper, there is widely known a solution comprising ethylenediaminetetraacetic acid (EDTA) or Rochelle salt as the complexing agent for a copper ion, and a solution comprising copper sulfate as the copper salt and formaldehyde as the reducing agent is most widely used. Research into complexing agents such as N,N,N',N'-tetrakis(2-hydroxypropyl)ethylenediamine and nitrilotriacetic acid has been made.

When these complexing agents are used, however, the electroless copper deposition speed is very low and usually 1 to 2 μm/hr. Namely, since additives are incorporated to improve the physical properties of the obtained copper film, the deposition speed is reduced. In the basic plating solution free of additives (consisting solely of a copper salt, a complexing agent, a reducing agent and a pH-adjusting agent), the deposition speed is about 10 μm/hr at highest. It was recently reported that a plating solution giving a highest deposition speed is a solution comprising N,N,N',N'-tetrakis(2-hydroxypropyl)ethylenediamine as the complexing agent and an activator, and a deposition speed of 72 μm/hr is obtained by this plating solution (Japanese Unexamined Patent Publication No. 59-25965). It has been also reported, however, that even if the above-mentioned plating solution is used, an applicable deposition speed is 2 to 5 μm (Japanese Unexamined Patent Publication No. 60-15917).

Current demands for an electroless copper plating solution having a high deposition speed are increasing, to reduce the cost of, for example, printed circuit boards. To meet this demand, there have been proposed a plating solution comprising an accelerator (Japanese Unexamined Patent Publication No. 60-15917) and a plating solution formed by adding an activator to a reducing agent (Japanese Unexamined Patent Publication No. 55-76054). These plating solutions, however, are not satisfactory, and the development of a plating solution showing a higher plating speed is required.

The present inventors previously showed that, by using a monoamine type trialkanolamine, especially triethanolamine, as the complexing agent and making this complexing agent function also as an accelerator, electroless copper plating can be performed at a speed as high as 100 ηm/hr or more, and even if an additive is added to improve the physical properties, a copper film having good physical properties can be formed at a speed as high as 30 to 120 μm/hr (see the specification of Japanese Patent Application No. 62-273493now Japanese Patent No. 1-168871).

Triethanolmonoamine acting as the complexing agent and accelerator in the above-mentioned high-speed electroless copper plating solution has a high stability in the form of a complex, and therefore, the reactivity is low and initiation of the reaction (plating) is not uniform. Accordingly, in the above-mentioned high-speed electroless copper plating solution, there is a need to easily initiate a stable plating reaction.

For example, if this high-speed electroless copper plating solution is applied to the full-additive preparation of a printed circuit board, then the formed copper film should excellent physical properties.

SUMMARY OF THE INVENTION

Therefore, a primary object of the present invention is to provide a high-speed electroless copper plating solution capable of easily initiating a stable reaction and providing a copper film having excellent physical properties, and a process for forming a copper film by using this plating solution.

In the present invention, to attain this object, in a high-speed electroless copper plating solution comprising a trialkanolmonoamine as the copper ion complexing agent and accelerator, an iron ion compound is used as the reaction initiator and a specific compound is used as the agent, to improve the physical properties of a plating film. Furthermore, the present invention relates to a process for forming a copper plating film by using this high-speed electroless copper plating solution.

More specifically, in accordance with the present invention, there is provided an electroless copper plating solution comprising a copper ion, a copper ion-complexing agent, a reducing agent, and a pH-adjusting agent, the plating solution comprising a trialkanolmonoamine or a salt thereof as a complexing agent and accelerator in an amount giving a copper deposition speed substantially higher than the copper deposition speed obtained when the trialkanolmonoamine or salt thereof is present in an amount sufficient to complex the copper ion but not enough to function as the accelerator, and $1.2\times10^{-4}$ to $1.2\times10^{-3}$ mole/l of an iron ion compound as a reaction initiator and/or $1.92\times10^{-4}$ to $1.92\times10^{-3}$ mole/l of at least one compound selected from the group consisting of pyridazine, methylpiperidine, 1,2-di-(2-pyridyl)ethylene, 1,2-di(pyridyl)ethylene, 2,2'-dipyridylamine, 2,2'-bipyridyl, 2,2'-bipyrimidine, 6,6'-dimethyl-2,2'-dipyridyl, di-2-pyridylketone, N,N,N',N'-tetraethylethylenediamine, naphthalene, 1,8-naphthyridine, 1,6-naphthyridine, tetrathiafurvalene, α,α,α-terpyridine, phthalic acid, isophthalic acid, and 2,2'-dibenzoic acid as an agent for improving the physical properties of a plating film.

Furthermore, in accordance with the present invention, there is provided a process for forming an electroless copper plating film by using this electroless copper coating solution.

DESCRIPTION OF THE PREFERRED EMBODIMENTS

Figure 1:
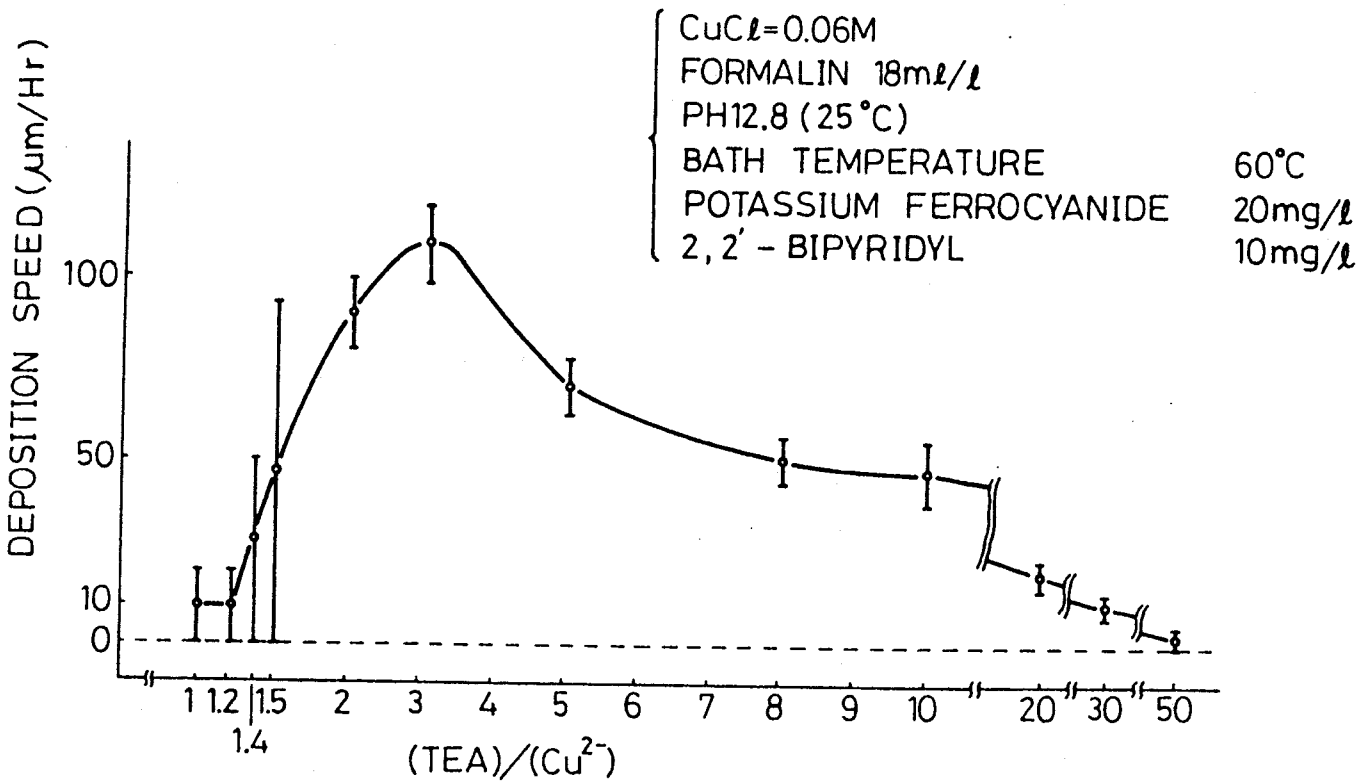
FIG. 1 is a graph illustrating the relationship between the amount of triethanolamine added and the copper deposition speed.

As the trialkanolmonoamine or its salt acting not only as a copper ion-complexing agent but also as an accelerator when used in an amount substantially larger than the amount required as the copper ion-complexing agent, triethanolamine and triisopropanolamine are easily available. As the salt, there can be mentioned hydrochlorides and phosphates. Preferably, the content of triethanolamine in the plating solution is 1.2 to 30 moles, more preferably 1.3 to 20 moles, per mole of the copper ion. Triisopropanolamine is preferably used in an amount of 1.5 to 3 moles per mole of the copper ion. If the trialcanolamine is used in such a molar excess, an electroless copper plating film can be deposited a speed as high as 10 μm or more, and deposition speed of 30 to 50 μm/hr or higher or a deposition speed of 100 to 160 μm/hr or higher can be obtained, although the deposition speed depends more or less on the kind of the additive. It has been found that preferably the absolute amount of the trialkanolamine or its salt is 0.006 to 2.4 moles/l, more preferably 0.012 to 1.6 moles/l.

An iron ion compound is added as the reaction initiator to the high-speed electroless copper plating solution. By the term "reaction initiator" used herein is meant a compound assuring initiation of the reaction at a specific bath temperature and a specific bath pH value in a trialkanolamine-containing plating solution. Even in the absence of the reaction initiator, the reaction starts by increasing the pH value of the plating solution or elevating the bath temperature above 70° C. Nevertheless, under practical plating conditions, the reaction can be initiated only with great difficulty in the absence of the reaction initiator. As the result of experiments made by the present inventors, it was found that an iron ion compound is effective as the reaction initiator for the trialkanolamine-containing high-speed plating solution. The iron ion compound is capable of releasing $Fe^{2+}$ or $Fe^{3+}$. For example, there can be mentioned ferrous chloride $FeCl_2$, ferric chloride $FeCl_3$, potassium ferrocyanide $K_4Fe(CN)_6$, potassium ferricyanide $K_3Fe(CN)_6$, sodium ferricyanide $Na_3Fe(CN)_6$ and sodium ferrocyanide $Na_4Fe(CN)_6$, and metal ferrocyanides, and sodium ferricyanide are preferably used. Preferably, the amount of the iron ion compound added is at least $1.2\times10^{-4}$ mole/l, especially $1.2\times10^{-4}$ to $1.2\times10^{-3}$ mole/l. If the amount of the iron ion compound is smaller than $1.2\times10^{-4}$ mole/l, the effect of initiating the reaction is not too low, and if the amount of the iron ion compound is too large, a precipitate of iron hydroxide or the like is formed and the physical properties of the obtained film become poor.

In the present invention, at least one compound selected from the group consisting of pyridazine, methylpiperidine, 1,2-di-(2-pyridyl)ethylene, 1,2-di(pyridyl-)ethylene, 2,2'dipyridylamine, 2,2'-bipyridyl, 2,2'-bipyrimidine, 6,6'-dimethyl-2,2'-dipyridyl, di-2-pyridylketone, N,N,N',N'-tetraethylethylenediamine, naphthalene, 1,8-naphthyridine, 1,6-naphthyridine, tetrathiafurvalene, α,α,α-terpyridine, phthalic acid, isophthalic acid and 2,2'-dibenzoic acid is added as the agent for improving the physical properties of the plating film. Among the above, 1,2-di-(2-pyridyl)ethylene, 2,2'-bipyridyl, 2,2'-bipyrimidine and 1,8-naphthyridine are preferably used. By experiments described hereinafter, it was found that these compounds are effective. The optimum amount added of the agent for improving the physical properties of the plating film depends on the compound used, but in general, the agent is added in an amount of at least $1.92\times10^{-4}$ mole/l, preferably $1.92\times10^{-4}$ to $1.92\times10^{-3}$ mole/l, more preferably $3.2\times10^{-4}$ to $1.3\times10^{-3}$ mole/l.

Surprisingly, we found that a 1,10-phenanthroline compound, regarded as able to greatly improve the physical properties of the film in conventional electroless copper plating solutions, provides no improvement of the high-speed triethanolmonoamine-containing plating solution, and that 6,6'-bi-2-picoline or 2.2'-bi-4-picoline formed by introducing a methyl group into 2,2'-bipyridyl, which greatly improves the physical properties, has no effect in the high-speed triethanolmonoamine-containing plating solution.

Any compound capable of providing a copper ion can be used as the copper salt, without limitation. For example, there can be mentioned copper sulfate $CuSO_4$, copper chloride $CuCl_2$, copper nitrate $Cu(NO_3)_2$, copper hydroxide $Cu(OH)_2$, copper oxide CuO and cuprous chloride CuCl. The amount of the copper ion present in the plating solution is generally 0.005 to 0.1 mole/l and preferably 0.01 to 0.07 mole/l. To obtain a plating speed higher than that of the conventional plating solutions, the amount of the copper ion must be at least 0.005 mole/l, though the value differs to some extent according to the plating solution conditions, and in view of the stability and from the economical viewpoint, preferably the amount of the copper ion is up to 0.1 mole/l.

Any compound capable of reducing the copper ion to metallic copper can be used as the reducing agent, without limitation, but formaldehyde, derivatives thereof, polymers thereof such as paraformaldehyde, and derivatives and precursors thereof are preferably used. The amount of the reducing agent is at least 0.05 mole/l, preferably 0.05 to 0.3 mole/l, as calculated as formaldehyde. To obtain a higher plating speed than that of the conventional plating solutions, the amount of the reducing agent must be at least 0.05 mole/l, and in view of the stability of the plating solution and from the economical viewpoint, preferably the amount of the reducing agent is up to 0.3 mole/l.

Any compound capable of changing the pH values can be used as the pH-adjusting agent, without limitation. For example, there can be mentioned NaOH, KOH, HCl, $H_2SO_4$ and HF. The pH value of the plating solution is generally 12.0 to 13.4 (25° C.), preferably 12.4 to 13.0 (25° C.). The dependency of the plating solution on the pH value is high, and to realize a high plating speed, preferably the pH value is 12.4 to 13.0. If the pH value exceeds 13, the stability of the plating solution is lowered.

Preferably, the temperature of the plating solution is from normal temperature to 80° C., more preferably from normal temperature to 70° C. Even at normal temperature (lower than 30° C.), the plating can be performed at a sufficiently high speed, but if the bath temperature exceeds 80° C., the stability of the plating solution is lowered.

The electroless copper plating treatment of the present invention can be carried out by any known procedures. In general, a substrate such as glass-epoxy, paper-phenol or ceramics is subjected to a preliminary treatment (such as washing or chemical roughening), catalyzed (usually, palladium is bonded) to impart a susceptibility to the deposition of copper) and then immersed in the plating solution to effect the electroless copper deposition.

In the case of a low catalytically active surface to be plated, for example, tungsten or molybdenum on a ceramic substrate, sometimes the plating by the high-speed trialkanolamine-containing plating solution is difficult. In this case, if an electroless copper plating is preliminarily carried out in a plating solution, different from the trialkanolamine-containing plating solution, which comprises a copper ion complex having a substantially lower stability constant as the complex than that of the trialkanolamine, to preform a thin copper deposition film on the surface to be plated, the electroless copper plating can be performed at a high speed, to a predetermined deposition thickness, by using the high-speed trialkanolamine-containing plating solution, whereby a high-speed plating becomes possible even on a low catalytically active surface to be plated (see Japanese Patent Application No. 63-101341). The technique of preforming a thin copper deposition film by using a low stable copper ion complex also can be applied to a surface to be plated, other than the above-mentioned low catalytically active surface, whereby a copper plating can be conducted while maintaining a greater control.

According to the present invention, the electroless copper plating can be performed at a much higher speed than in the conventional electroless copper plating solutions, initiation of the plating reaction can be assured, and the physical properties of the obtained copper film can be greatly improved.

EXAMPLES

The present invention will now be described in detail with reference to the following examples, that by no means limit the scope of the invention.

REFERENTIAL EXAMPLE 1

(triethanolamine-containing high-speed plating solution)

A stainless steel sheet having a size of 3 cm×7 cm (area=about 40 $cm^2$) was degreased, washed, and treated with a Pd catalyst solution (for example, Cataposit 44 supplied by Siplay). Then the substrate was washed with water and activated by an Accelerator 19 supplied by Siplay. The thus-pretreated stainless steel sheet was then subjected to electroless plating with an ethylenediaminetetraacetic acid (EDTA) plating solution having a composition shown in Table 3, for 2 minutes, to form a copper foil having a thickness of 0.1 to 0.2 μm, the plated stainless steel sheet was washed with water and then subjected to electroless plating with 500 cc of a prepared triethanolamine plating solution, for 10 minutes. The deposition speed was measured by an electrolytic film thickness meter and the obtained value was converted to the deposition speed per hour. The plating load was 80 $cm^2/l$. Note, NaOH was used for the adjustment of the pH value.

TABLE 1

Copper Foil-Forming Plating Solution for Sampling Data

| Component | Concentration |
|---|---|
| $CuCl_2$ | 0.06M |
| EDTA | 0.08M |
| Formalin | 18 ml/l |
| pH (25° C.) | 12.5 |
| Bath temperature | 50° C. |

The plating solution was continuously air-stirred by air blowing, and mechanical stirring was not performed.

The prepared triethanolamine (TEA) plating solution was as described below, and the change of the deposition speed by the change of the TEA concentration was examined.

The results are shown in FIG. 1.

| | |
|---|---|
| $CuCl_2$ | 0.06M |
| Formalin* | 18 ml/l |
| TEA | |
| Potassium ferrocyanide | 20 mg/l |
| 2,2'-Bipyridyl | 10 mg/l |
| pH (25° C.) | 12.8 |
| Bath temperature | 60° C. |

Note
Formalin* is a 37% aqueous solution of formaldehyde.

From FIG. 1, it is seen that a high-speed plating is possible if triethanolamine is added in an amount of at least 1.2 equivalents to the copper ion.

REFERENTIAL EXAMPLE 2

(reactivity of plating solution with substrate)

Since triethanolamine has a larger stability constant as the copper complex, in general, little initiation of the reaction occurs, and especially in a portion having a low catalytic activity, an initiation of the reaction is difficult. In the dependency of the deposition speed on triethanolamine/$Cu^{2+}$ shown in FIG. 1, little initiation of the reaction occurs if the amount of truethanolamine is small, i.e., the ratio r of [TEA]/[$Cu^{2+}$] is lower than 1.2, and if the reaction is initiated when the ratio r is about 1.5, the deposition speed is very high and exceeds 100 μm/hr. Note sometimes the reaction is not initiated even if the ratio r is about 1.5 or higher.

This initiation of the reaction is influenced by various conditions of the plating solution. After due investigation, it was found that the initiation of the reaction depends greatly on the state of the surface to be treated, i.e., the catalytic activity and surface condition. For example, a stainless steel sheet can be plated by an EDTA plating solution but cannot be plated by a triethanolamine plating solution. In a Pd catalyst-bonded stainless steel sheet, the activity is uneven and a difference is brought about by the catalyst solution. In the case of a glass-epoxy substrate, however, if the substrate is etched and Pd is then bonded by using a catalyst solution, the reaction is smoothly initiated and advanced.

The triethanolamine plating solution used in this example was described in Referential Example 1.

TABLE 2

| Substrate (catalyst) | Empirically Found Reactivity of Plating Solution with Substrate — Reactivity (whether or not reaction is initiated): TEA solution | EDTA solution | (TEA + EDTA) solution | TEA solution + EDTA solution |
|---|---|---|---|---|
| Stainless steel sheet | x | ○ | x | ○ |
| Stainless steel sheet + Pd catalyzed | Δ | ◎ | ○ | ◎ |
| Glass-epoxy sheet + Pd catalyzed | ◎ | ◎ | ◎ | ◎ |
| Stainless steel sheet + copper foil | ○ | ◎ | ◎ | ◎ |

Note
x: no substantial reaction
Δ: difference brought about by catalyst solution
○: substantial reaction
◎: Excellent reaction

EXAMPLE 1

(reaction initiator)

The copper foil of a glass-epoxy/copper foil laminate was chemically etched to obtain a roughened epoxy surface. Then the roughened epoxy surface was treated at 45° C. for 2 minutes with a pre-dip solution (cataprip 404 supplied by Siplay) and treated at 45° C. for 4 minutes with a Pd catalyst solution (Cataposit 44 supplied by Siplay), and the treated laminate was washed with water and treated at normal temperature for 4 minutes with an activating solution (Accelerator 19 supplied by Siplay), to obtain a material to be plated for a test piece.

The obtained substrate was pre-plated for 10 minutes by using the following plating solution.

| | |
|---|---|
| $CuCl_2$ | 0.04 mole/l |
| EDTA-4Na* | 0.06 mole/l |
| 2,2'-Bipyridyl | 20 mg/l |
| NaOH | 2.5 g/l |
| Polyethylene glycol (mole-weight = 2000) | 1 g/l |
| Formalin | 6 ml/l |

Note
EDTA-4Na: tetra-sodium ethylenediaminetetraacetate

A copper foil was deposited in a thickness of about 0.2 μm on the surface of the substrate by this pre-plating.

The thus-prepared substrate was immersed in a high speed plating solution formed adding an ion compound to the following basic solution, and it was determined whether or not the reaction had been initiated. The basic plating solution free of the ion compound was used as the reference solution.

| | |
|---|---|
| $CuCl_2$ | 0.04 mole/l |
| TEA* | 0.12 mole/l |
| NaOH | 6.5 g/l |
| Formalin | 12 ml/l |
| 2,2'-Bipyridyl | 50 mg/l |
| Bath temperature | 60° C. |

Note
*triethanolamine

In this basic solution, to prevent an accidental initiation of the reaction, as much as possible, 2,2'-bipyridyl was added in a large amount but EDTA as the low stable complexing agent was not added. This was because it was empirically found that, when the amount of 2,2'-bipyridyl is small, the reaction is readily initiated and if a low stable complexing agent (EDTA), which is an agent preventing the stoppage of the reaction is present, the reaction is readily initiated.

When an ion compound was not added, little initiation of the reaction occurred (the reaction was initiated in three immersion runs from among ten immersion runs). Various ion compounds were added, and it was determined whether or not the initiation of the reaction was greatly improved with regard to the above-mentioned basic case where an ion compound was not added. Mark "o" indicates that an effect of initiating the reaction occurred and mark "x" indicates that such an effect did not occur.

The results of the examination of compounds capable of releasing a component ion of potassium ferrocyanide are shown in Table 3, and the results of the examination of other ion-releasing compounds are shown in Table 4.

TABLE 3

| Constituent Element | Additive | Amount Added | Presence or Absence of Initiating Effect |
|---|---|---|---|
| $K^{1+}$ | KCl | 0.25 g/l | x |
| $Fe^{2+}$ | $FeCl_2.xH_2O$ | 0.13 g/l | ○ |
| $Fe^{3+}$ | $FeCl_3.6H_2O$ | 0.25 g/l | ○ |
| $CN^-$ | NaCN | 0.25 g/l | x |
| $Fe(CN)_6^{4-}$ | $Na_4Fe(CN)_6$ | 0.30 g/l | ○ |
| $Fe(CN)_6^{3-}$ | $K_3Fe(CN)_6$ | 0.30 g/l | ○ |

TABLE 4

| Kind of Metal Ion | Additive | Amount Added | Presence or Absence of Initiating Effect |
|---|---|---|---|
| $Co^+$ | $CoCl.6H_2O$ | 0.30 g | x |
| $Ni^+$ | $NiSO_4.6H_2O$ | 0.15–0.30 g | x |
| $Sn^{2+}$ | $SnCl_2.2H_2O$ | 0.20 g | x |
| $Sn^{4+}$ | $SnCl_4.XH_2O$ | 0.20 g | x |
| $Zn^{2+}$ | $ZnCl_2$ | 0.20 g | x |
| $Mn^{2+}$ | $MnCl_2.4H_2O$ | 0.20 g | x |
| $Cr^{6+}$ | $CrO_3$ | 0.06–0.20 g | x |
| $V^{5+}$ | $V_2O_{10}$ | 0.20 g | x |
| $Al^{3+}$ | $Al(OH)_3$ | 0.30 g | x |
| $Ru^{2+}$ | $RuCl_2.XH_2O$ | 0.20 g | x |

From Table 3, it is seen that $Fe^{2+}$ or $Fe^{3+}$ promotes the initiation of the reaction. It is considered that the equilibrium reaction of $Fe^{2+} \rightleftharpoons Fe^{3+} + e^-$ makes a contribution to the initiation of the plating reaction. The results of the experiments based on the supposition that the equilibrium reaction of another metal ion would make a contribution to the initiation of the reaction are shown in Table 4. It was found, however, that ions other than the iron ion have no effect of promoting the reaction.

From the foregoing experimental results, it is confirmed that an iron ion compound is effective as the reaction initiator for the electroless copper plating in a high-speed trialkanolamine-containing plating solution. In view of the solubility in the plating solution, a metal ferrocyanide and a metal ferricyanide are preferably used.

Note, it must be taken into consideration that the high-speed reaction is initiated in the trialkanolamine-containing plating solution even in the absence of a reaction initiator as mentioned above, and that the probability of the initiation of the reaction is low in the absence of the reaction initiator. As a means of increasing the probability of the initiation of the reaction, there can be considered an increase of the pH value, an elevation of the bath temperature, and an addition of a large amount of a low stability complexing agent, but plating under such severe conditions is not practically preferable, and by using the above-mentioned reaction initiator, the reaction can be initiated without fail even under practical conditions.

EXAMPLE 2

(effect of improving physical properties of Film

The same substrate as used in Example 1 was prepared, preliminarily treated, and pre-plated for 20 minutes in the following plating solution.

| | |
|---|---|
| $CuCl_2$ | 0.04 mole/l |
| EDTA | 0.06 mole/l |
| 2,2'-Bipyridyl | 20 mg/l |
| Polyethylene glycol (molecular weight = 2000) | 1 g/l |
| NaOH | 2.5 g/l |
| Formalin | 5 ml/l |
| Bath temperature | 60° C. |

A copper film having a thickness of about 0.5 μm was deposited on the surface of the substrate by this pre-plating.

The obtained substrate was immersed for 20 minutes in a plating solution formed by adding 5 mg/l or 50 mg/l of an additive to the following basic plating solution (high-speed plating solution), the gloss of the obtained plating film was evaluated with the naked eye, and the physical properties were judged. In the high-speed plating solution, the obtained film was blackish and porous, and it was found that if a small amount of 2,2'-bipyridyl is added, a skin-colored gloss was manifested. Accordingly, it is considered that the physical properties of the film can be judged based on the gloss of the film. A small amount of potassium ferrocyanide was added as the reaction initiator, because if potassium ferrocyanide is added in a large amount, it cannot be determined the improvement of the physical properties is due to the action of the additive alone or due to the combined use of the additive and potassium ferrocyanide.

| | |
|---|---|
| $CuCl_2$ | 0.04 mole/l |
| TEA | 0.12 mole/l |
| NaOH | 6.5 g/l |
| Formalin | 12 ml/l |
| Potassium ferrocyanide | 5 mg/l |
| Bath temperature | 60° C. |

The results are shown in Table 5. In Table 4, mark "o" indicates a good gloss, mark "Δ" indicates a relatively good gloss, and mark "x" indicates that the film was blackish and porous. Many compounds other than the compounds shown in Table 5 were tested, but compounds not showing any effect of improving the physical properties of the film are not listed therein. As such ineffective additives, there can be mentioned pyridine (shown in Table 5 for comparison), pyrazine, pyrimidine, 1,3,5-triazine, 1,2-di-(pyridyl)ethane, 1,3-di-(4-pyridyl)propane, 2,3'-bipyridyl, 2,4'-bipyridyl, 3,3'-bipyridyl, 4,4'-bipyridyl, diphenyl, 2-phenylpyridine, 3-phenylpyridine, 4-phenylpyridine 4,4'-dimethyl-2,2'-dipyridyl, di-2-pyridylketone, 2,2'-pyridyl, 6-pyridoin, DL-α,β-di-(4-pyridyl)glycol, 1,10-phenanethroline, 5-methyl-1,10-phenanethroline, neocuproine, 3,4,7,8-tetramethyl-1,10-phenanthroline, 5-nitro-1,10-phenanthroline, N,N,N',N'-tetramethyldiaminimethane, N,N,N',N'-tetramethyl-1,3-diaminopropane, N,N,N',N'-tetramethylhexanediamine, 1,3-naphthyridine, benzo(c)cinnoline, 2-(2-thienyl)pyridine, 2,2'-bithiophene, basophenanthroline, basocuprophine, 2,4,6-tris-triazine, ferrodine, terephthalic acid and 1,8-naphthalene-dicarboxylic anhydride.

TABLE 5

| Name and Structural Formula | Amount Added | Appearance |
|---|---|---|
| Pyridine 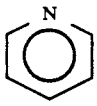 | (1) 5 mg/l<br>(2) 50 mg/l | x<br>x |
| Pyridazine 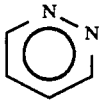 | (1) 5 mg/l<br>(2) 50 mg/l (excessive NaOH) | Δ<br>Δ |
| Methylpiperidine 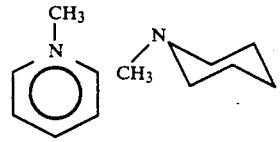 | (1) 5 mg/l<br>(2) 50 mg/l | Δ<br>Δ |

TABLE 5-continued

| Name and Structural Formula | Amount Added | Appearance |
|---|---|---|
| 1,2-di-(2-pyridyl)ethylene 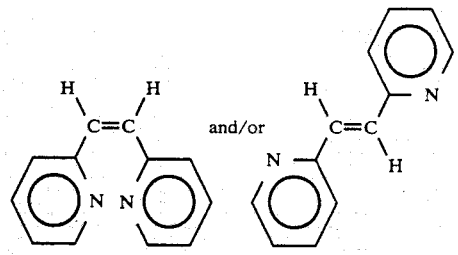 | (1) 5 mg/l<br>(2) 50 mg/l | Δ<br>o |
| 1,2-di-(4-pyridyl)ethylene 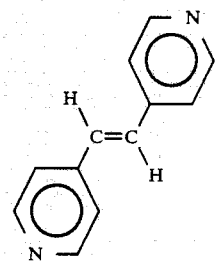 | (1) 5 mg/l<br>(2) 50 mg/l | Δ<br>x |
| 2,2-dipyridylamine 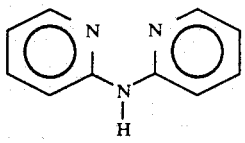 | (1) 5 mg/l<br>(2) 50 mg/l | x<br>Δ |
| 2,2'-bipyridyl 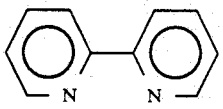 | (1) 5 mg/l<br>(2) 50 mg/l | Δ<br>o |
| 2,2-bipyrimidine 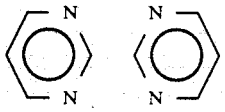 | (1) 50 mg/l | o |
| 6,6'-dimethyl-2,2'-dipyridine (6,6'-bi-2-picoline) 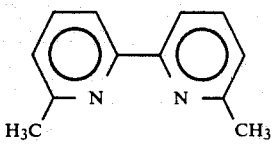 | (1) 5 mg/l<br>(2) 50 mg/l | x<br>Δ |
| di-2-pyridylketone 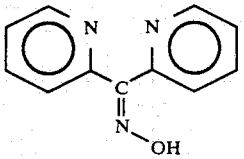 | (1) 5 mg/l<br>(2) 50 mg/l | x<br>Δ |
| N,N,N',N'-tetraethylethylenediamine 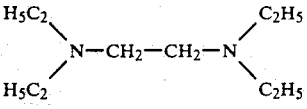 | (1) 5.5 mg/l<br>(2) 55.1 mg/l | x<br>Δ |

TABLE 5-continued

| Name and Structural Formula | Amount Added | Appearance |
|---|---|---|
| naphthalene 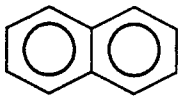 | (1) 5 mg/l<br>(2) 50 mg/l | x<br>Δ |
| 1,8-naphthyridine 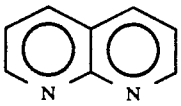 | (1) 5 mg/l<br>(2) 50 mg/l | Δ<br>o |
| 1,6-naphthyridine 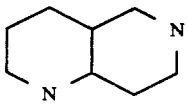 | (1) 5 mg/l<br>(2) 50 mg/l | Δ<br>Δ |
| Tetrathiafuralene 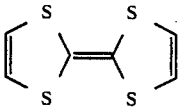 | (2) 50 mg/l | Δ |
| α,α,α-terpyridine 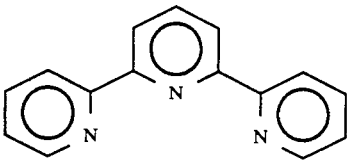 | (1) 5 mg/l<br>(2) 50 mg/l | Δ<br>Δ |
| phthalic acid 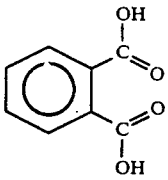 | (1) 5 mg/l<br>(2) 50 mg/l | Δ<br>Δ |
| isophthalic acid 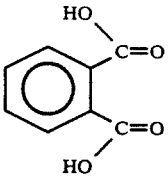 | (1) 5 mg/l<br>(2) 50 mg/l | Δ<br>Δ |
| 2,2'-dibenzoic acid 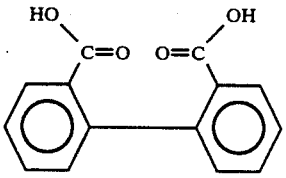 | (1) 5 mg/l<br>(2) 50 mg/l | x<br>Δ |

EXAMPLE 3

(test of physical properties of film)

In view of the results obtained in Examples 1 and 2, potassium ferrocyanide $K_4[Fe(CN)_6]$ was used as the reaction initiator, 2,2'-bipyridyl

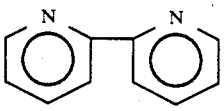

was used as the agent for improving the physical properties, Fe-95 (anionic surface active agent supplied by 3M) was used as the surface active agent, and the changes of the physical properties of the film by the amount added of the additive and by the bath conditions were examined.

Figure 2:
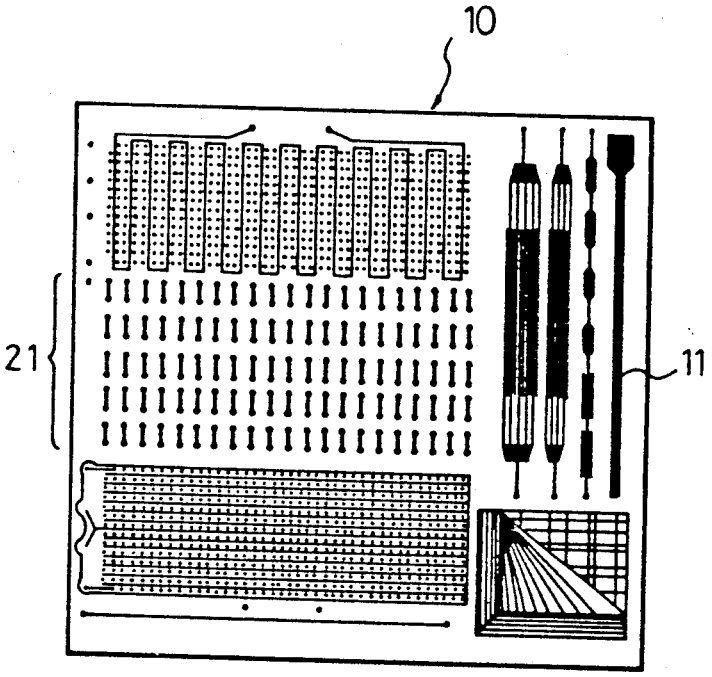
FIG. 2 is a diagram illustrating a test pattern of a printed board.

The same substrate as used in Example 1 was pretreated in the same manner as described in Example 1 except that, after the Pd catalyzing treatment and water washing, a test pattern as shown in FIG. 2 was formed by using a liquid photoresist (Probimar supplied by Ciba-Geigy). Then, in the same manner as described in Example 1, the activation treatment was carried out, and the pre-plating was carried out for 20 minutes. The following plating solution was used for the pre-plating.

| | |
|---|---|
| $CuCl_2$ | 0.4 mole/l |
| EDTA | 0.06 mole/l |
| 2,2'-Bipyridyl | 20 g/l |
| Polyethylene glycol (molecular weight = 2000) | 1 g/l |
| NaOH | 2.5 g/l |
| Formalin | 5 ml/l |
| Bath temperature | 60° C. |

The following plating solution was used for the high-speed plating conducted after the pre-plating.

| | |
|---|---|
| $CuCl_2$ | 0.04 mole/l |
| TEA | 0.12 mole/l |
| NaOH | 6.5 g/l |
| Formalin | 6 ml/l |
| Fe-95 | 0.1 g/l |

To this plating solution, potassium ferrocyanide and 2,2'-bipyridyl were further added (see Table 6), and the plating time was adjusted to 3 hours.

The obtained printed plate 10 was baked at 140° C. for 2 hours and coated with a solder.

Figure 3:
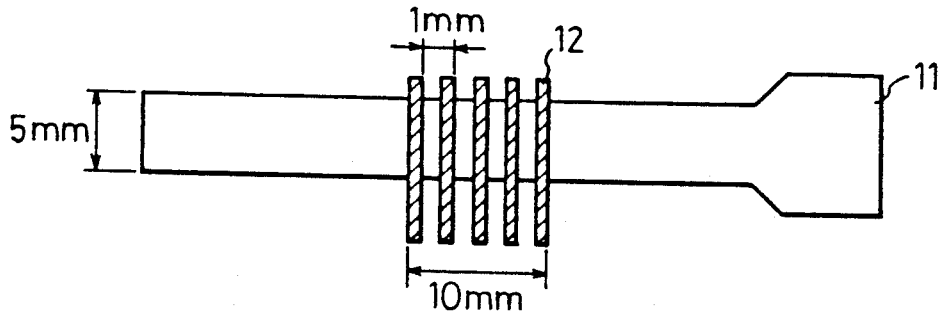
FIGS. 3 and 4 are diagrams illustrating peeling patterns for the tensile test among test patterns.
Figure 4:
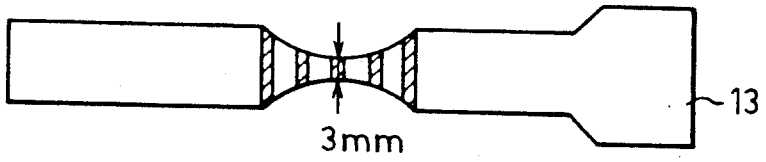

Marks at a 1 mm pitch were formed on a peeling pattern portion 11, as shown in FIG. 3, and the pattern portion 11 was peeled. After the peeling, a central portion having a width of 3 mm was cut out as a sample, by sharp scissors, and this sample 13 was subjected to a tensile test. The pattern portion 11 was slightly elongated by the peeling, but this elongation was ignored.

Figure 5:
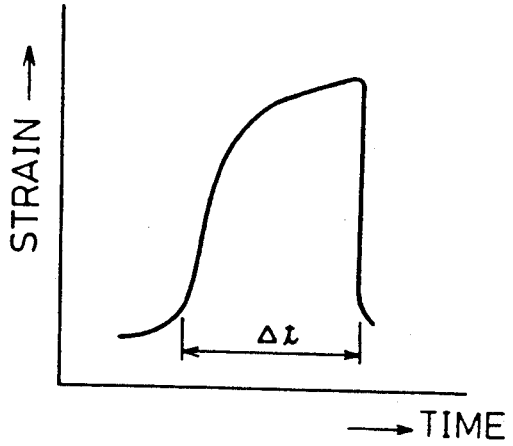
FIG. 5 is a time-strain curve at the tensile test.

In the tensile test, the test piece was pulled at a pulling speed of 3 mm/min by using a tensile tester (Model UTM-1-2500 supplied by Hitachi Keiki), and the elongation quantity Δt was determined from the obtained time-strain curve (see FIG. 5). The deformation quantity T (see FIG. 6) of the broken test piece was measured, and the elongation was determined from the following formula:

$$\text{Elongation (\%)} = \frac{\Delta t}{T} \times 100$$

The thickness of the test piece 11 was measured by a micrometer and the sectional area was determined, and the tensile force was calculated from the stress at break.

The results are shown in Table 6.

TABLE 6

Physical Properties of Film

| | | Run | | | | | |
|---|---|---|---|---|---|---|---|
| | | A | B | C | D | E | F |
| Potassium ferrocyanide | (mg/l) | 300 | 300 | 500 | 100 | 300 | 500 |
| 2,2'-bipyridyl | (mg/l) | 100 | 200 | 200 | 200 | 300 | 300 |
| EDTA-4Na | (mole/l) | 0.01 | 0.01 | 0.01 | 0.01 | 0.01 | 0.01 |
| bath temperature | (°C.) | 60 | 70 | 65 | 60 | 65 | 60 |
| film thickness | (μm) | 56 | 42 | 52 | 45 | 65 | 50 |
| tensile force | ($kg/mm^2$) | 29.6 | 30.0 | 29.4 | 29.9 | 27.5 | 25.4 |
| elongation | (%) | 19.6 | 13.8 | 11.6 | 12.9 | 15.3 | 14.4 |

| | | Run | | | | | | |
|---|---|---|---|---|---|---|---|---|
| | | G | H | I | J | K | L | M |
| Potassium ferrocyanide | (mg/l) | 100 | 100 | 100 | 100 | 300 | 100 | 500 |
| 2,2'-bipyridyl | (mg/l) | 100 | 300 | 100 | 300 | 100 | 100 | 100 |
| EDTA-4Na | (mole/l) | 0.01 | 0.01 | 0.005 | 0.005 | 0.005 | 0.02 | 0.005 |
| bath temperature | (°C.) | 65 | 70 | 60 | 65 | 70 | 70 | 65 |
| film thickness | (μm) | 60 | 37 | 55 | 65 | 65 | 56 | 30 |
| tensile force | ($kg/mm^2$) | 20.8 | 24.2 | 29.9 | 15.8 | 27.7 | 23.6 | 29.8 |
| elongation | (%) | 12.0 | 17.4 | 14.1 | 8.7 | 13.8 | 13.8 | 11.1 |

COMPARATIVE EXAMPLE

The procedures of Example 3 were repeated in the same manner except that the plating treatment was carried out for 30 hours, using the following conventional EDTA plating solution instead of the high-speed plating solution.

| | |
|---|---|
| $CuSO_4$ | 0.4 mole/l |
| EDTA-4Na | 0.06 mole/l |
| Formalin | 5 ml/l |
| NaOH | 2.5 g/l |
| 2,2-Bipyridyl | 20 mg/l |
| Potassium ferrocyanide | 40 mg/l |
| Polyethylene glycol (molecular weight = 2000) | 1 g/l |
| Bath temperature | 70° C. |

The physical properties of the obtained film were measured in the same manner as described in Example 3, and the results are shown in Table 7.

TABLE 7

| Film Thickness | Tensile Force | Elongation |
|---|---|---|
| 35 μm | 31.5 $kg/mm^2$ | 7.8% |

From the results shown in Tables 6 and 7 it is seen that, according to the present invention, a plating film having a higher quality can be obtained at a higher speed than when the conventional EDTA plating solution is used, although the effect differs to some extent according to the amounts of potassium ferrocyanide, 2,2'-bipyridyl, and EDTA, and the bath temperature. The plating speed and elongation are collectively shown in Table 8. This quality (elongation of 15 to 20%) is comparable to the quality (elongation of 12 to 20%) obtained by the electro-plating.

TABLE 8

| | TEA High-Speed Bath | Conventional EDTA Bath |
|---|---|---|
| plating speed | about 20 μm/hr | about 1 μm/hr |
| elongation | 15 to 20% | 7 to 8% |

EXAMPLE 4

In the same manner as described in Example 3, the changes of the elongation of the film due to changes of the amounts of potassium ferrocyanide and 2,2'-bipyridyl were examined. The results are shown in FIGS. 5 and 6.

From FIG. 5, it is seen that the elongation of the film depends greatly on the amount of potassium ferrocyanide, and good results are obtained when the amount of potassium ferrocyanide is 50 to 500 mg/l, especially 100 to 400 mg/l. If the reaction initiator is used in an amount exceeding this range, a precipitate of iron hydroxide or the like is formed and the physical properties are lowered.

Figure 6:
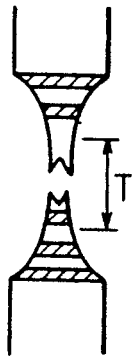
FIG. 6 is a diagram illustrating the amount of deformation of a test piece.

From the results shown in FIG. 6, it is seen that the elongation of the film depends on the amount of 2,2'-bipyridyl, and good results are obtained when the amount of 2,2'-bipyridyl is 30 to 300 mg/l, especially 50 to 200 mg/l. If the amount added of 2,2'-bipyridyl is too large, an uneven reaction occurs or the reaction is not initiated, and a precipitate is formed. Accordingly, the physical properties of the film are lowered.

EXAMPLE 5

The experiment was carried out in the same manner as described in Example 3, except that the bath temperature was changed. When the additive was used in a small amount, for example, 20 mg/l of 2,2'-bipyridyl or 30 mg/l of potassium ferrocyanide, the elongation of the film was largest (10.5%) at the bath temperature of 50° C.

Example 6

The hot oil test was carried out by using a through hole connecting pattern 21 of the test pattern 10 prepared in Example 3, and the change of the resistance value was examined. In the oil test, the immersion in silicone oil at 260° C. for 5 seconds and immersion in silicone oil at 15° C. for 20 seconds was repeated, and the quality of the pattern was evaluated based on the change of the resistance value. A film having the highest physical properties was obtained when the plating solution of Run A in Example 3 was used.

For comparison, the same connecting pattern prepared by using the EDTA bath described in the comparative example and the same connecting pattern prepared by the subtractive method were similarly tested.

Figure 7:
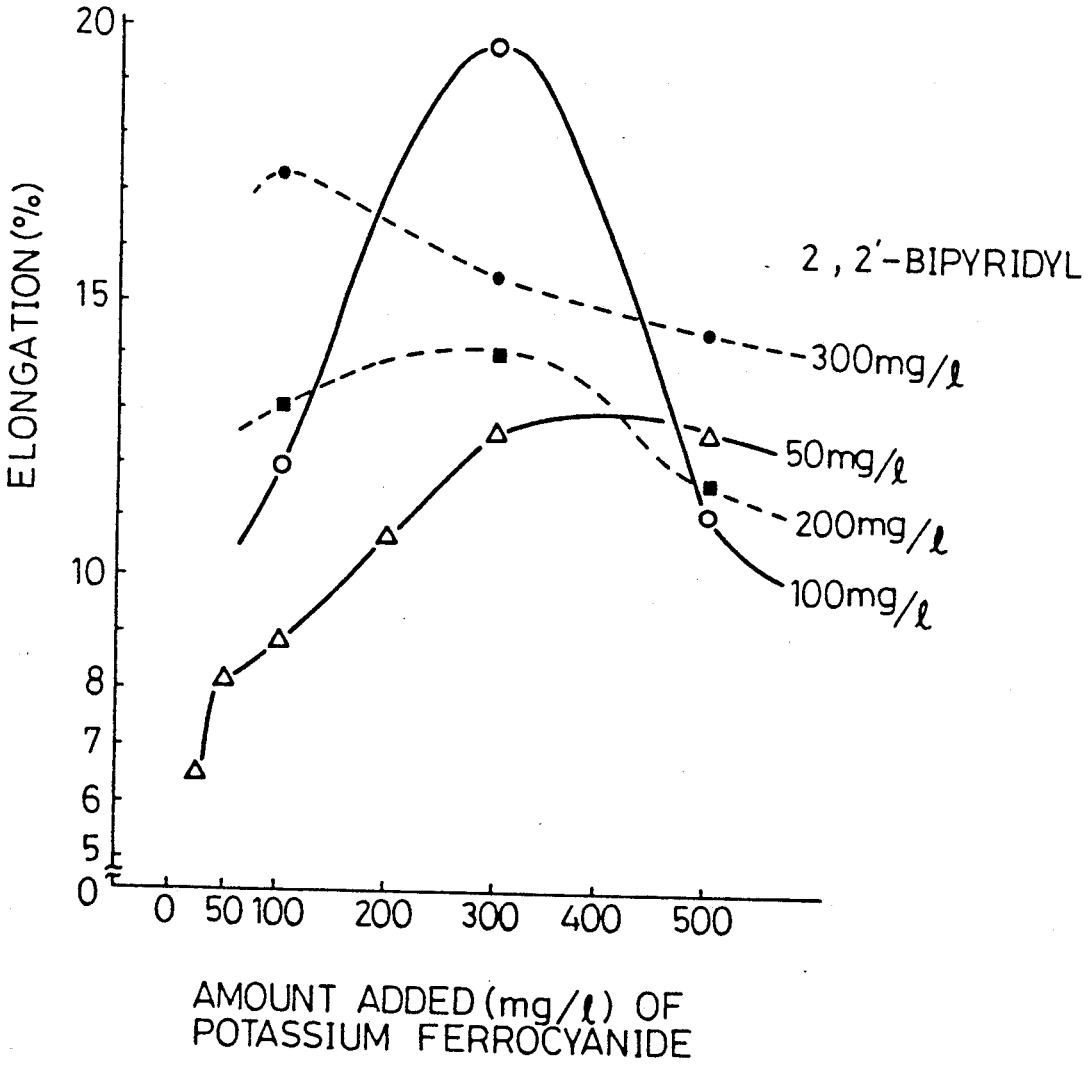
FIG. 7 is a graph illustrating the relationship between the amounts of potassium ferrocyanide and 2,2'-bipyridyl added in a high-speed plating solution and the elongation of the film.
Figure 8:
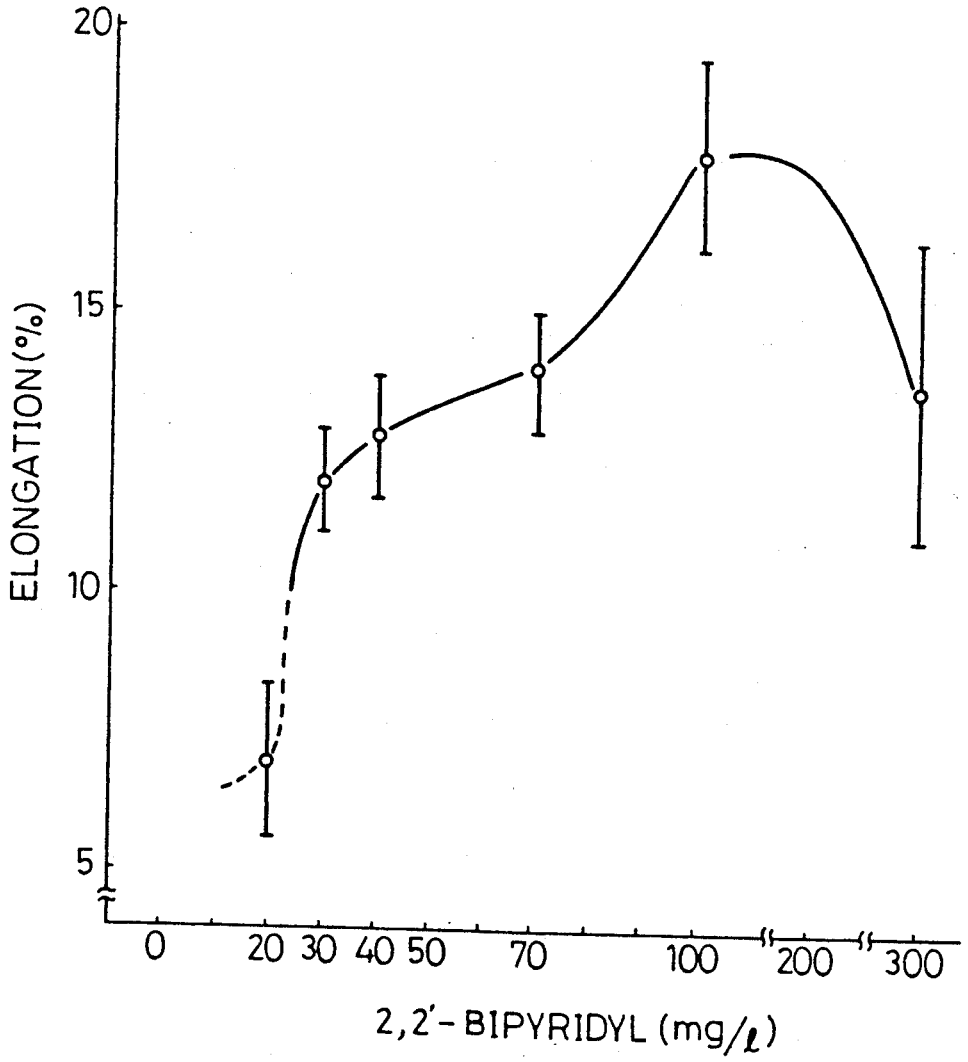
FIG. 8 is a graph illustrating the relationship between the amount of 2,2'-bipyridyl added and the elongation of the film.
Figure 9:
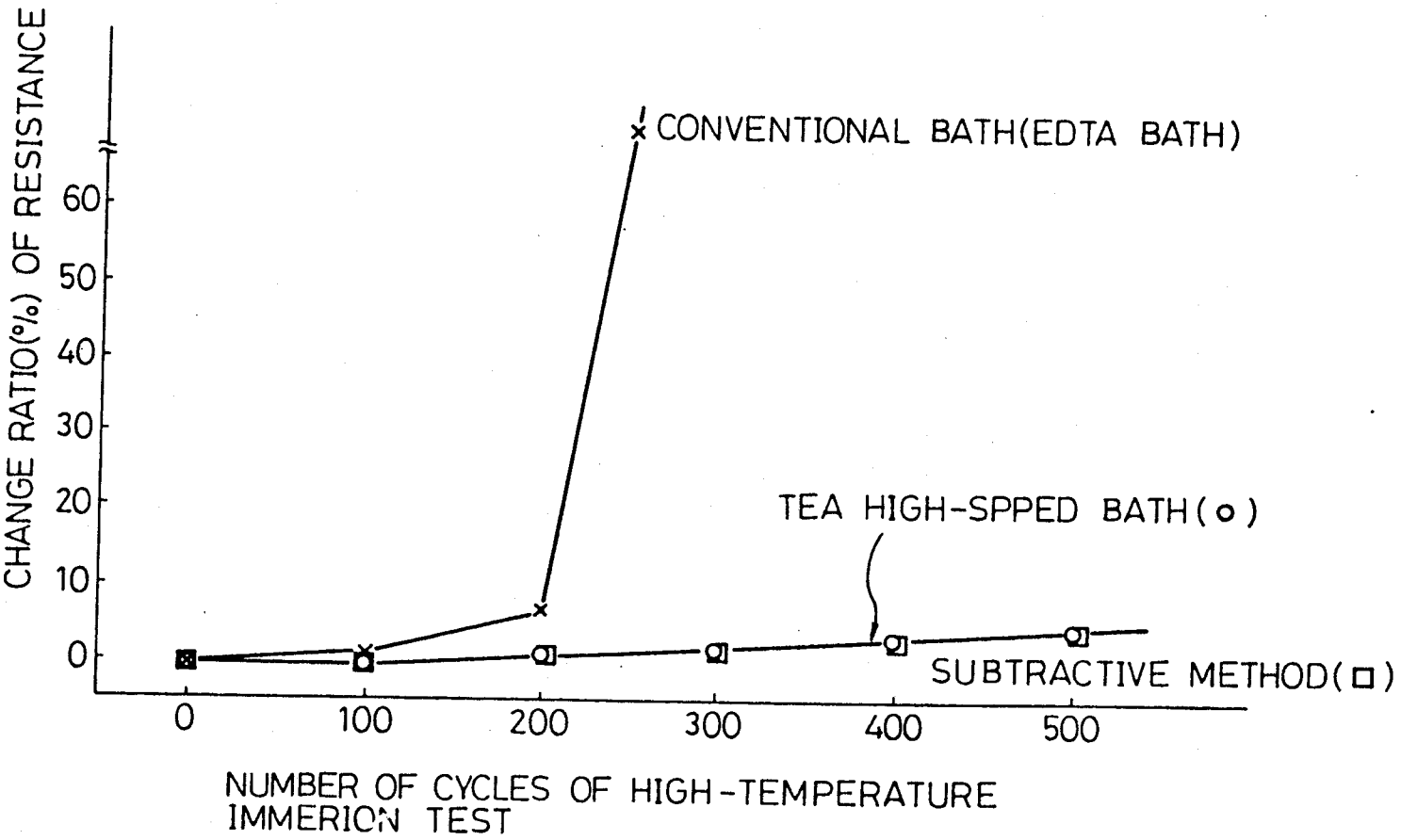
FIG. 9 is a graph illustrating the results of the hot oil test.

The results are shown in FIG. 7, and it is seen that, in the conventional bath EDTA bath, elongation=7.8%), breaking occurred at the 200th cycle, but in the high-speed bath of the present invention (elongation =19.6%), the resistance value did not change even at the 500th cycle and the quality is comparable to that obtainable according to the substractive method.

We claim:

1. An electroless copper plating solution comprising a copper ion, a copper ion-complexing agent, a reducing agent and a pH-adjusting agent, said reducing agent being formaldehyde, or derivatives or polymers thereof, and said plating solution comprising a trialkanolmonoamine or a salt thereof as a complexing agent and accelerator in an amount giving a higher copper deposition speed than the copper deposition speed obtained when the rialkanolmonoamine or salt thereof is present in an amount sufficient to complex the copper ion but not enough to function as the accelerator, and at least $1.2\times10'$ mole/l of an iron ion compound as a reaction initiator.

2. An electroless copper plating solution as set forth in claim 1, wherein the iron ion compound is contained in an amount of $1.2\times10^{-4}$ to $1.2\times10^{-3}$ mole/l.

3. An electroless copper plating solution as set forth in claim 1, wherein the trialkanolmonoamine or the salt thereof is contained in an amount of 1.2 to 30 moles per mole of the copper ion.

4. An electroless copper plating solution comprising a copper ion, a copper ion-complexing agent, a reducing agent and a pH-adjusting agent, said reducing agent being formaldehyde, or derivatives or polymers thereof, and said plating solution comprising a trialkanolmonoamine or a salt thereof as a complexing agent and accelerator in an amount giving a higher copper deposition speed than the copper deposition speed obtained when the trialkanolmonoamine or salt thereof is present in an amount sufficient to complex the copper ion but not enough to function as the accelerator, and at least $1.92\times10^{-4}$ mole/l of at least one compound selected from the group consisting of pyridazine, methyliperidine, 1,2-di-(2-pyridyl)ethylene, 1,2-di-(pyridyl)ethylene, 2,2'-dipyridylamine, 2,2'-bipyridyl, 2,2'-bypyrimidine, 6,6'-dimethyl-2,2'-dipyridyl, di-2-pyridylketone, N,N,N',N'-tetraethylethylenediamine, napthalene, 1,8-naphthyridine, 1,6-naphthyridine, tetrathiafurvalene, α,α,α-terpyridine, phthalic acid, isophthalic acid and 2,2'-dibenzoic acid as an agent for improving the physical properties of a plating film.

5. An electroless copper plating solution as set forth in claim 4, wherein the agent for improving the physical properties of the film is contained in an amount of $1.92\times10^{-4}$ to $1.92\times10^{-3}$ mole/l.

6. An electroless copper plating solution as set forth in claim 4, wherein the trialkanolmonoamine or the salt thereof is contained in an amount of 1.2 to 30 moles per mole of the copper ion.

7. An electroless copper plating solution comprising a copper ion, a copper ion-complexing agent, a reducing agent and a pH-adjusting agent, said reducing agent being formaldehyde, or derivative or polymers thereof, and said plating solution comprising a trialkanolmonoamine or a salt thereof as a complexing agent and accelerator in an amount giving a higher copper deposition speed than the copper deposition speed obtained when the trialkanolmonoamine or salt thereof is present in an amount sufficient to complex the copper ion but not enough to function as the accelerator, and at least $1.2\times10^{-4}$ mole/l of an iron ion compound as a reaction initiator and at least $1.92\times10^{-4}$ mole/l of at least one compound selected from the group consisting of pyridazine, methylpiperidine, 1,2-di(2-pyridyl)ethylene, 1,2-di-(pyridyl)ethylene, 2,2'-dipyridylamine, 2,2'-bipyridyl, 2,2'- bipyrimidine, 6,6'-dimethyl-2,2'-dipyridyl, di-2-pyridylketone, N,N,N',N'-tetraethylethylenediamine, naphthalene, 1,8-naphthyridine, 1,6-naphthyridine, tetrathiafurvalene, α,60 ,α-terpyridine, phthalic acid, isophthalic acid and 2,2'-dibenzonic acid as an agent for improving the physical properties of a plating film.

8. An electroless copper plating solution as set forth in claim 7, wherein the iron ion compound is contained in an amount of $1.2\times10^{-4}$ to $1.2\times10^{-3}$ mole/l and the agent for improving the physical properties of the film is contained in an amount of $1.92\times10^{-4}$ to $1.92\times10^{-3}$ mole/l.

9. An electroless copper plating solution as set forth in claim 7, wherein the iron ion compound is at least one metal ferrocyanide or metal ferricyanide.

10. An electroless copper plating solution as set forth in claim 7, wherein the iron ion compound is contained in an amount of $1.2\times10^{-4}$ to $1.2\times10^{-3}$ mole/l.

11. An electroless copper plating solution as set forth in claim 7, wherein the agent for improving the physical properties of the film is at least one member selected from the group consisting of 1,2'-di-(2pyridyl)ethylene, 2,2'-bipyridyl, 2,2'-bipyrimidine and 1,8-naphthyridine.

12. An electroless copper plating solution as set forth in claim 7, wherein the agent for improving the physical properties of the film is contained in an amount of $1.92\times10^{-4}$ to $1.92\times10^{-3}$ mole/l.

13. An electroless copper plating solution as set forth in claim 7, wherein the trialkanolmonoamine or the salt thereof is contained in an amount of 1.2 to 30 moles per mole of the copper ion.

* * * * *